US005351602A

United States Patent [19]

Monroe

[11] Patent Number: 5,351,602

[45] Date of Patent: Oct. 4, 1994

[54] JOINTED ASSEMBLY ACTUATED BY FLUID PRESSURE

[75] Inventor: John W. Monroe, Warren, Mich.

[73] Assignee: The United States of America as represented by the Secretary of the Army, Washington, D.C.

[21] Appl. No.: 925,048

[22] Filed: Aug. 5, 1992

[51] Int. Cl.[5] ..... F01B 21/02

[52] U.S. Cl. ..... 92/64; 60/413; 901/22

[58] Field of Search ..... 92/48, 64, 92; 901/22; 60/413, 418, 471, 484; 91/454, 457, 530

[56] References Cited

U.S. PATENT DOCUMENTS

| | | | |
|---|---|---|---|
| 3,587,233 | 6/1971 | Fischbach | 60/418 X |
| 4,702,148 | 10/1987 | Kussel et al. | 91/530 X |
| 4,739,692 | 4/1988 | Wassam et al. | 92/48 X |
| 4,751,869 | 6/1988 | Paynter | 92/92 |
| 4,784,042 | 11/1988 | Paynter | 92/48 X |
| 4,801,239 | 1/1989 | Austad | 901/22 X |
| 4,819,547 | 4/1989 | Kukolj | 92/92 X |
| 4,841,845 | 6/1989 | Beullens | 92/92 |
| 5,014,600 | 5/1991 | Krauter et al. | 92/92 |
| 5,129,279 | 7/1992 | Rennex | 901/22 |

*Primary Examiner*—Edward K. Look
*Assistant Examiner*—Hoang Nguyen
*Attorney, Agent, or Firm*—Peter A. Taucher; David L. Kuhn

[57] ABSTRACT

The invention is an assembly of a plurality of relatively movable jointed members such as robotic arm segments and a mechanical muscle connected between two of the segments. The muscle has a longitudinally inflexible, radially expandable sleeve containing a pressurizable bladder of elastic material. The bladder enlarges diametrically when pressurized and bulges the wall of the sleeve outward. The sleeve thereupon contracts axially to compensate for taken up by the sleeve's outward bulge. A terminus at either end of the sleeve connects the sleeve to different segments of a jointed arm, so that the sleeve's axial contraction effects movement of one segment relative to the other.

7 Claims, 4 Drawing Sheets

JOINTED ASSEMBLY ACTUATED BY FLUID PRESSURE

GOVERNMENT USE

The invention described herein may be manufactured, used and licensed by or for the U.S. Government for governmental purposes without payment to me of any royalty.

BACKGROUND AND SUMMARY

The invention herein relates to jointed assemblies in which one member is moved relative to another by means of hydraulic or pneumatic power. Such assemblies include, for example, automatically opening doors, robotic limbs or any assembly where hydraulic or pneumatic cylinders effect mechanical movement between parts.

The invention is a jointed assembly actuated by a mechanical muscle. The muscle includes a longitudinally inflexible but radially or circumferentially expandable sleeve surrounding a pressurizable bladder of elastic material. The bladder expands when pressurized and bulges the wall of the sleeve outward, whereby the sleeve contracts axially to compensate for length taken up by the sleeve's bulge. Terminus means at either end of the sleeve connect the sleeve to different components of the jointed assembly so that the sleeve's axial contraction effects relative movement between the components.

DETAILED DESCRIPTION

Figure 1:
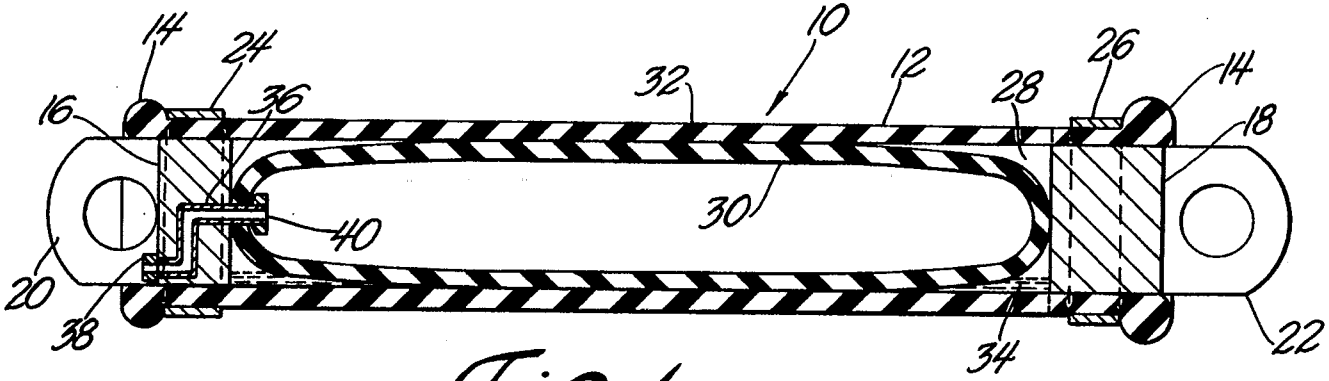
FIG. 1 is a sectional view of a robotic arm actuator, or mechanical muscle, shown in a relaxed, free configuration, the fibers being omitted from FIG. 1 for convenience.

In FIG. 1 is shown a mechanical muscle 10 whose outer sleeve 12 has annular beads 14 at either end, the sleeve and beads being a composite of fiber and elastomeric material. Sealingly fit at either end of outer sleeve 12 are plug-like terminuses 16 and 18 from which mount respective pivot eyes 20 and 22. Band clamps 24 and 26 adjacent beads 14 hold sleeve 12 in tightly gripped sealing engagement with the terminuses. Within compartment 28 defined by the sleeve and terminuses is an elongate, generally cylindrical bladder 30. The bladder is made of elastomeric material so that it can expand diametrically.

In the relaxed, free state of bladder 10 shown in FIG. 1, the bladder preferably extends from terminus 16 to terminus 18 and contacts sleeve 12 at the intermediate zone 32 thereof. It is also preferred that the outer peripheral surface of bladder 30 be covered with a lubricative fluid and that compartment 28 be partly filled with such fluid, as shown at 34. The lubricative fluid will ease relative sliding movement between the bladder and the sleeve during operation of the mechanical muscle. Bladder 30 is filled with hydraulic fluid or a gas via duct 36 leading from within the bladder through terminus 16. Duct 36 has opening 40 within bladder 30 communicated with an external opening at fitting 38 at the outer side of terminus 16.

Figure 2:
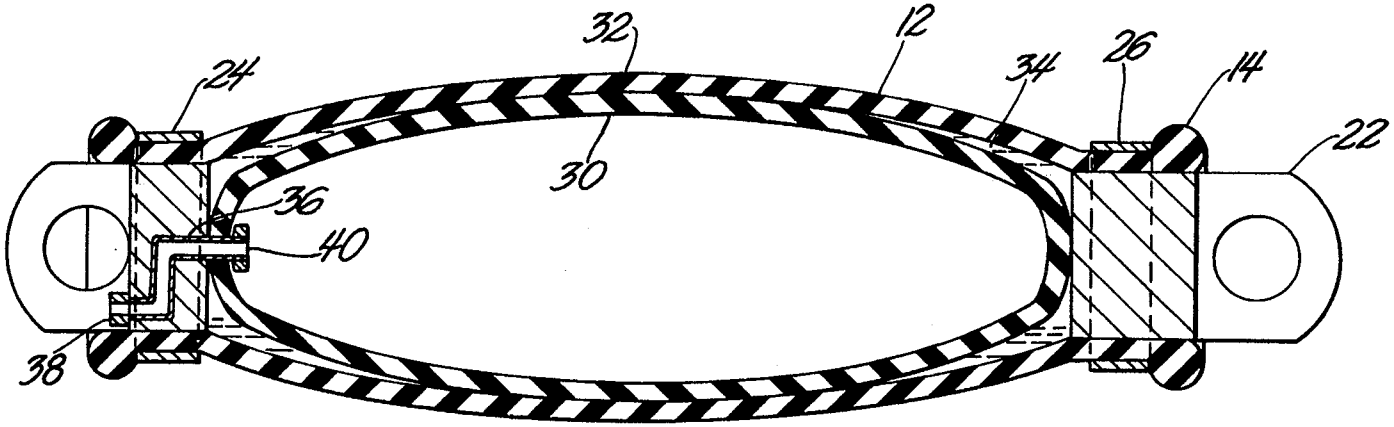
FIG. 2 is another sectional view of my actuator shown in a diametrically enlarged, axially contracted state, the fibers being omitted for convenience.
Figure 1A:
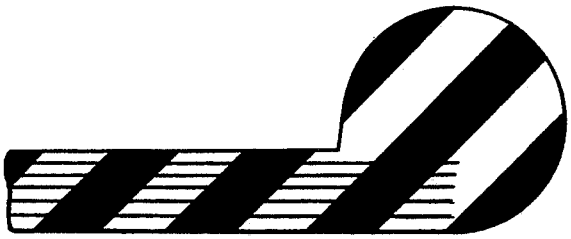
FIG. 1A is a sectioned detail view of a portion of the sleeve and a bead integral therewith shown in FIG. 1, FIG. 1A showing the fibers omitted from FIGS. 1 and 2.

When fluid is forced into bladder 30, the bladder will reshape from its FIG. 1 configuration to its axially shorter, diametrically expanded configuration of FIG. 2. Bladder 30 in FIG. 2 has a more volumetrically efficient shape, i.e., a smaller surface-to-volume ratio, than the FIG. 1 configuration. The bladder now takes up essentially all the free space in compartment 28 so that lubricative fluid 34 now surrounds the bladder. The strength of sleeve 12 is such that it will prevent bursting of the bladder even when the bladder is pressurized at several hundred psi.

Figure 3:
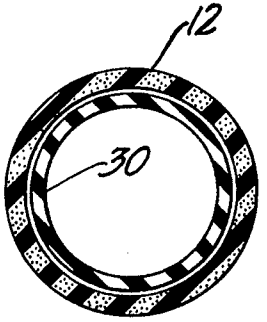
FIG. 3 is a radial cross section of a fiber reinforced elastomeric sleeve and a bladder of the mechanical muscle.

FIG. 3 is a typical radial cross section of bladder 30 in sleeve 12 when mechanical muscle 10 is in the free, relaxed configuration shown by FIG. 1. The ends of longitudinal fibers running axially with respect to the muscle are represented by the dots in sleeve 12. The fibers have high tensile strength and reinforce sleeve 12 in the longitudinal direction so that sleeve 12 has much greater resistance to longitudinal expansion than does bladder 30. The fibers run only in the longitudinal direction so that sleeve 12 has relatively reduced resistance to circumferential stretch.

Figure 4:
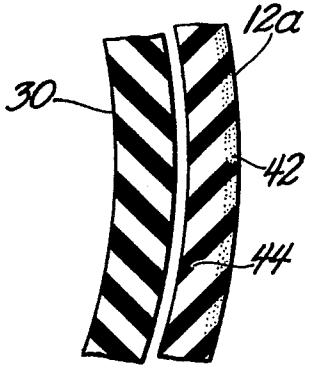
FIG. 4 is a partial radial cross sectional view of an alternate structure for the walls of the actuator's sleeve and an adjacent portion of the bladder.

FIG. 4 shows a variation in the wall structure of sleeve 12 wherein the longitudinal fibers are concentrated at outer diametrical zone 42. It is contemplated that the diametrically inner zone 44 of sleeve 12 will undergo compression along an axial bend and undergo tension in a circumferential direction when the sleeve reshapes from its FIG. 1 configuration to its FIG. 2 configuration. The absence of fibers from diametrically inner zone 44 will enable the elastomeric matrix of sleeve 12 to better adapt to the simultaneous bending compression and circumferential tension.

Figure 5:
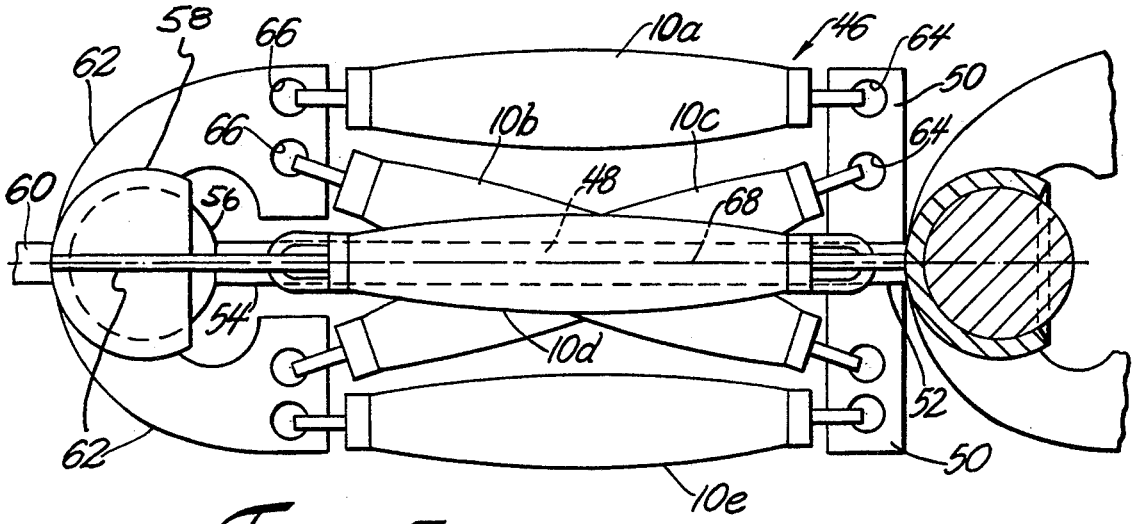
FIGS. 5 and 7 show assemblies of mechanical muscles and robotic arms, some hidden lines being omitted in the interest of clarity.
Figure 6:
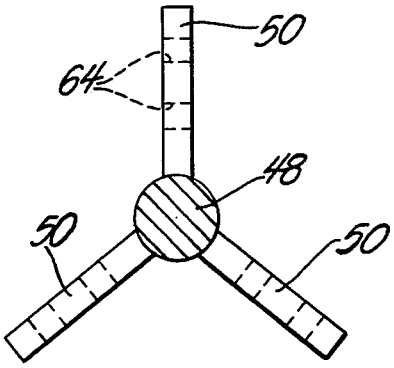
FIG. 6 is a sectional view of the arm in FIG. 5 showing the orientation of struts radiating from the arm.

FIG. 5 shows an assembly 46 of a robotic arm 48 and a set of attached muscles **10*a* through 10*e*, the arm having three elongate struts 50 radiating from one end 52 as seen in conjunction with FIG. 6. At the opposite end 54 of the robotic arm is affixed ball 56 which swivels in socket 58, solidly attached to a structural member 60 or another arm. Projecting from socket 58 are three curved plates 62 which are in planar alignment with respective struts 50. The struts and plates define respective apertures 64 and 66 which are used for the attachment of muscles 10***a* through 10*e*.

Muscles 10*b* and 10*c* are connected between struts 50 and plates 62 such that they are both oblique to axis 68 of arm 48. When one of these muscles contracts, arm 48 undergoes movement relative to member 60, a component of this movement being a twist about axis 68. Muscles 10*b* and 10*c* are opposing muscles in that the contraction of muscle 10*b* causes a twist component in the opposite angular direction from the twist component caused by muscle 10*c*.

Muscles 10*a*, 10*d* and 10*e* are all connected parallel to axis 68. When muscle 10*a* contracts, arm 48 swings away from axis 68 in the general plane defined by the strut 50 and plate 62 to which muscle 10*a* is attached, a similar swing occurring when muscles 10*d* or 10*e* contract. Any particular combination of arm twist relative to component 60 and movement of arm 48 away from axis 48 is achieved by actuating a selected subset of muscles 10*a* through 10*e* and by controlling the degree of contraction of the muscle subset.

Figure 7:
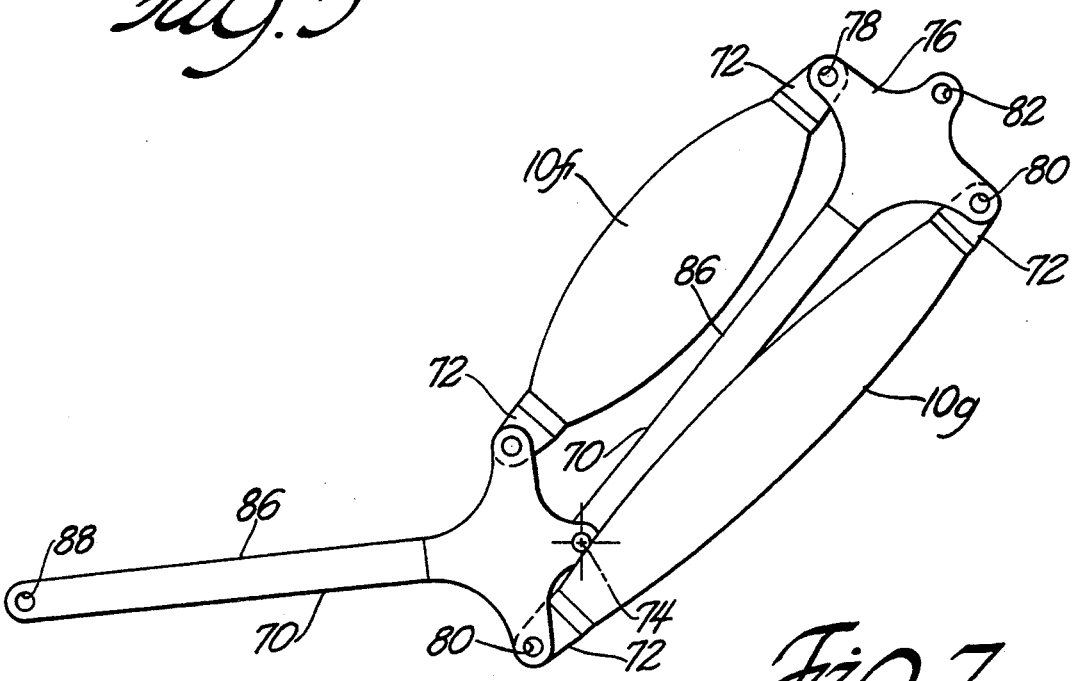
Figure 8:
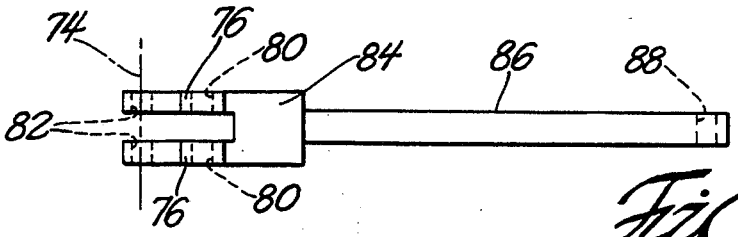
FIG. 8 is a top elevational view of one of the arms shown in FIG. 7.
Figure 9:
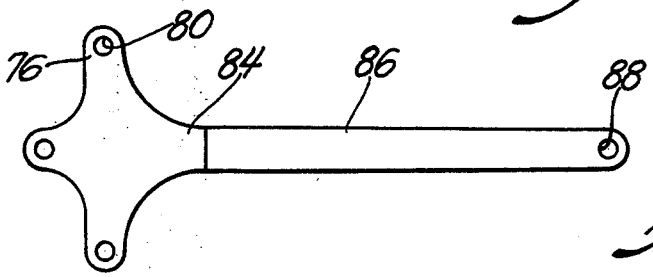
FIG. 9 is a side elevational view of the arm shown in FIG. 8.

A relatively simple jointed arm structure is shown in FIG. 7 wherein arms 70 pivot in a common plane relative to each other about axis 74, further views of these arms being shown in FIGS. 8 and 9. Each arm 70 has one end comprised of parallel, somewhat cruciform plates 76 that each have apertures 78, 80 and 82, the apertures of one plate aligning with the apertures of the other. The cruciform plates join at zone 84 from which extends an elongate flat bar 86 whose terminus defines aperture 88. The terminus of one arm fits between plates 76 of another arm so that aperture 88 aligns with apertures 82 of these plates. A pivot pin (not shown) or the like is passed through the aligned apertures.

Still referring to FIG. 7, muscles 10*f* and 10*g* are connected between plates 76 of the respective arms, muscle 10*f* being in the contracted state. The FIG. 7 muscles have flat apertured ears 72 at either end, the ears sliding between plates 76 into registry with apertures 78 and 80. Pivot pins (not shown) or the like can be used to rotatably fasten ears 72 between respective pairs of plates 76. Contraction of muscle 10*f* pivots arm 70 in the clockwise direction in FIG. 7 whereas contraction of muscle 10*g* pivots arm 70 in the counterclockwise direction.

Figure 10:
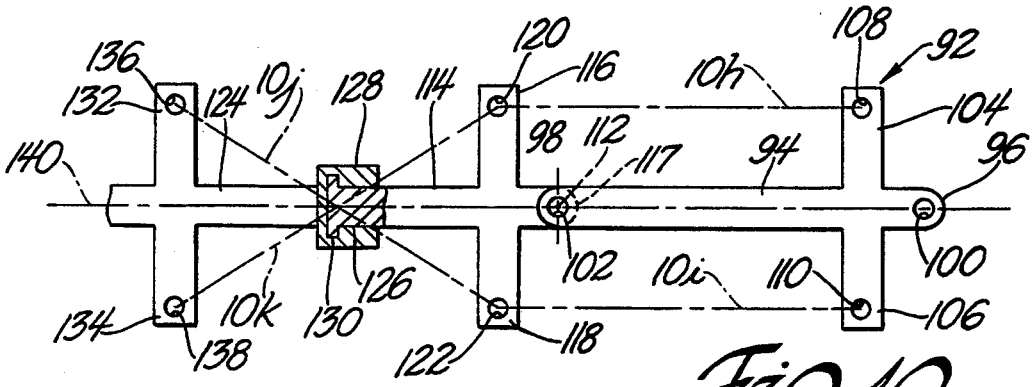
FIG. 10 is a third alternate robotic arm structure, the placement of mechanical muscles schematically represented by dot-dash lines.

FIG. 10 shows another jointed arm structure wherein the mechanical muscles 10*h*, 10*i*, 10*j* and 10*k* are represented as phantom lines. A relatively flat T-shaped arm element 94 has rounded ends 96 and 98 that define respective apertures 100 and 102. Arm element 94 has struts 104 and 106 which engage muscles 10*h* and 10*i* at respective apertures 108 and 110. Pivotally connected at axis 112 to arm element 94 is another T-shaped arm element 114, element 114 having a rounded end 117 defining a hole that registers with aperture 102 of element 94. Elements 94 and 114 are rotatably attached by any suitable means such as a pivot pin.

Arm element 114 has a pair of struts 116 and 118 similar to corresponding struts 104 and 106 of arm element 94, the former struts defining apertures 120 and 122 for respectively engaging muscles 10*h* and 10*i* and also for engaging respective muscles 10*k* and 10*j*. It can be seen that contraction of muscle 10*h* will pivot arm element 94 counterclockwise about axis 112 if arm element 114 remains stationary and similarly, contraction of muscle 10*i* will pivot arm element 94 clockwise.

Arm element 114 has a pivotal socket connection with arm element 124 that includes a stepped cylindrical terminus 126 integral arm element 114. Rotatable with respect to terminus 126 is a complimentary internally stepped cylindrical socket 128, an annular ridge 130 of terminus 126 fitting closely within an enlarged internal diameter portion of socket 128. Socket 128 is integrally connected to arm element 124.

Arm element 124 has a pair of struts 132 and 134 similar to the corresponding pairs of struts on the other arm elements of the other two arm elements in FIG. 10. Struts 132 and 134 define apertures 136 and 138 by which these struts are connected to respective muscles 10*j* and 10*k*. Muscles 10*j* and 10*k* are oriented obliquely to common axis 140 of arm elements 114 and 124, whereby contraction of one of these muscles turns arm element 124 about axis 140, the contraction of muscle 10*j* causing an opposite angular turn from muscle 10*k*.

Figure 11:
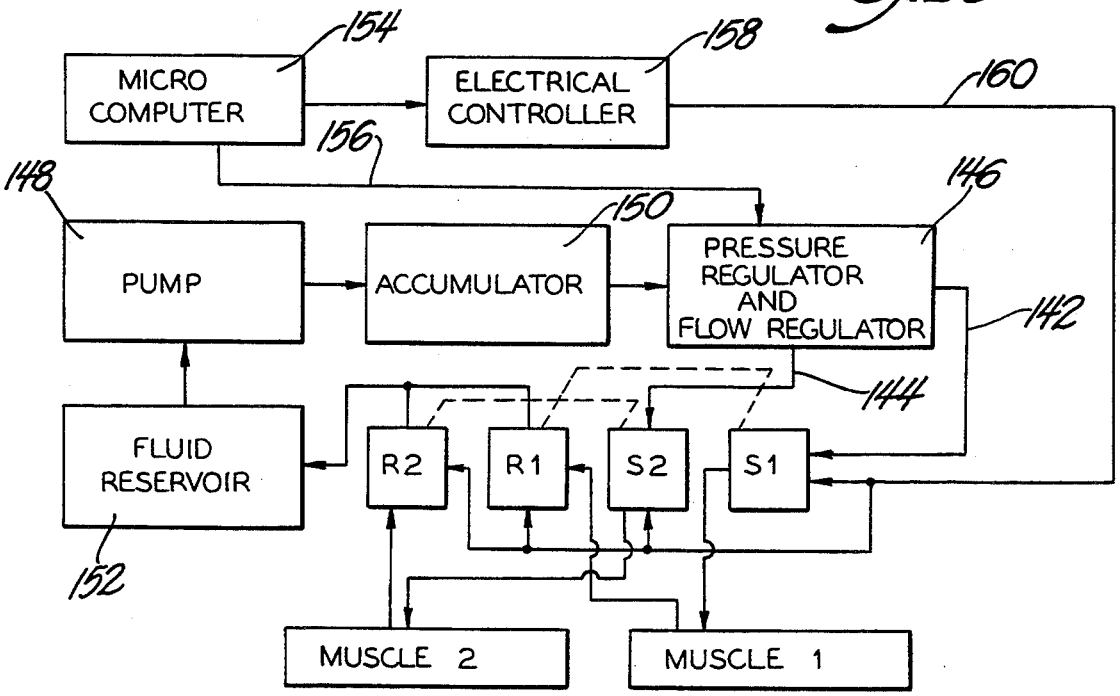
FIG. 11 is a schematic diagram showing the entire hydraulic or pneumatic system of which the mechanical muscles are part.

FIG. 11 shows a schematic diagram of an electronically controlled hydraulic circuit for controlling the actuation and de-actuation of an opposed pair of mechanical muscles. Muscle 1 and muscle 2 in FIG. 11 would correspond, for example, to opposed muscles 10*f* and 10*g* in FIG. 7. Associated with muscle 1 are supply valve S1 and relief valve R1, both of which preferably communicate with the same duct 38 (FIG. 1), although it is possible to have separate supply and relief ducts communicating bladder 30 to valves S1 and R1 respectively. Muscle 2 communicates with supply valve S2 and relief valve R2 in the same way that muscle 1 communicates with valves S1 and S2. Use of one duct for both supply and release of fluid from muscles is preferred because it reduces the number of hydraulic lines controlling a given set of muscles and thus reduces the tendency of the lines to interfere with nearby parts of a robotic arm assembly.

Supply valves S1 and S2 receive hydraulic fluid through lines 142 and 144 from regulator 146, which selects the valve to receive flow and which controls flow rate and pressure so as to govern the speed and force of muscle contraction. Regulator 146 acts in response to signals from microcomputer 154 sent over communication line 156. Regulator 146 receives pressurized fluid from pump 148, the fluid preferably stored in a high pressure accumulator 150 prior to flowing to regulator 146. Pump 148 draws fluid from a reservoir 152, which receives fluid released from the muscles via relief valves R1 and R2.

It is preferred that valves S1, S2, R1 and R2 be electrically actuated by means of an electric controller 158, which itself is governed by control signals from microcomputer 154. It is contemplated that controller 158 will send out a multiplex signal over line 160 and each valve will respond only to that valve's portion of the multiplex signal. Such an arrangement will simplify the wiring needed to control a complex system of robotic muscles. It is, of course, possible to replace line 160 with several lines from electrical controller 158, one line to each valve.

I wish it to be understood that I do not desire to be limited to the exact details of construction shown and described herein since obvious modifications will occur to those skilled in the relevant arts without departing from the spirit and scope of the following claims.

What is claimed is:

1. A mechanical muscle comprising:

a muscle longitudinal axis;

a flexible sleeve disposed along the muscle axis and resistant to elongation along the muscle axis;

a smooth inner peripheral surface of the sleeve;

terminus means at ends of the sleeve for sealing the sleeve;

a flexible, outwardly expandable bladder within the sleeve, a smooth outer peripheral surface of the bladder slidable against the inner peripheral surface of the sleeve, the bladder and sleeve defining a void therebetween;

a free state of the bladder occurring during a relaxed state of the muscle;

an outwardly expanded state of the bladder occurring during a tensed state of the muscle;

a first volume of the void occurring during the relaxed state of the muscle;

a second volume of the void smaller than the first volume occurring during the muscle's tensed state;

one or more fluids sealed within the void;

wherein the fluid exerts greater pressure on an exterior surface of the bladder during the tensed state of the muscle than during the relaxed state.

2. The muscle of claim 1 wherein the fluid comprises:

a lubricative liquid occupying a constant volume in the void;

a gas occupying a remainder of the void;

wherein the liquid a occupies greater proportion of the void during the muscle's tensed state than during the muscle's relaxed state, the liquid filling a majority of the void and surrounding the bladder during the tensed state.

3. A fluidically actuatable jointed limb assembly, incorporating the muscle of claim 2, the assembly comprising:

a plurality of the muscles;

a first arm;

a longitudinal axis of the first arm;

a second arm movably attached to the first arm;

attachment means for connecting the muscles between the first arm and the second arm;

wherein one of the muscles is oriented parallel to the longitudinal axis of the first arm and another of the muscles is oriented oblique to the longitudinal axis.

4. The muscle of claim 2 wherein:

the sleeve is formed of a matrix of elastomeric material surrounding nonintersecting reinforcement fibers all oriented along the muscle axis and running the length of the sleeve, the reinforcement fibers having higher tensile strength than the elastomeric material.

5. A mechanical muscle comprising:

a muscle longitudinal axis;

a flexible sleeve disposed along the muscle axis and formed of a matrix of elastomeric material, the matrix reinforced by elongate nonintersected fibers running the length of the sleeve, the fibers all oriented along the muscle axis and running the length of the sleeve, the fibers having more tensile strength than the elastomeric material;

a first zone of the matrix containing the fibers;

a second zone of the matrix closer to the muscle axis than the first zone and adjacently joined to the first zone, the second zone being free of the fibers;

a flexible, outwardly expandable bladder within the sleeve, an outer peripheral surface of the bladder slidable against an inner peripheral surface of the sleeve.

6. The muscle of claim 5 further comprising:

terminus means at either end of the sleeve for sealing the sleeve;

the sleeve and bladder defining a void therebetween;

a fluid in the void;

wherein the terminus means, the sleeve and the fluid cooperate to exert greater than atmospheric pressure on 100% of an exterior surface of the bladder during the tensed state of the muscle.

7. A mechanical muscle comprising:

a muscle longitudinal axis;

a flexible sleeve disposed along the muscle axis and resistant to elongation along the muscle axis wherein the sleeve includes a two-layered means to simultaneously reinforce the sleeve, counteract thinning of a sleeve wall during radial expansion of the sleeve and compensate for longitudinal bending compression of the sleeve wall;

an outer layer of the two-layered means formed of elastomeric matrix material containing fibers disposed axially relative to the muscle axis, the fibers having higher tensile strength than the matrix material;

an inner layer of the two-layered means made of elastomeric material and disposed closer to the muscle axis than the outer layer and adjacently fixedly joined to the outer layer, the inner layer being free of the fibers;

a smooth inner peripheral surface of the sleeve;

terminus means at ends of the sleeve for sealing the sleeve;

a flexible, outwardly expandable bladder within the sleeve, a smooth outer peripheral surface of the bladder slidable against the inner peripheral surface of the sleeve, the bladder and sleeve defining a void therebetween;

a free state of the bladder occurring during a relaxed state of the muscle;

an outwardly expanded state of the bladder occurring during a tensed state of the muscle;

a first volume of the void occurring during the relaxed state of the muscle;

a second volume of the void smaller than the first volume, the second volume occurring during the muscle's tensed state;

fluids sealed within the void, the fluids comprising a lubricative liquid occupying a constant volume in the void and a gas occupying a remainder of the void;

wherein the liquid a occupies greater proportion of the void during the muscle's tensed state than during the muscle's relaxed state, the liquid filling a majority of the void and surrounding the bladder during the tensed state;

wherein the fluids exert greater pressure on an exterior surface of the bladder during the tensed state of the muscle than during the relaxed state.

* * * * *